United States Patent [19]

Hamagami et al.

[11] Patent Number: 4,994,108

[45] Date of Patent: Feb. 19, 1991

[54] PROCESS FOR PRODUCING HIGH CLEANNESS EXTRA LOW CARBON STEEL

[75] Inventors: Kazuhisa Hamagami; Masayuki Onishi, both of Chiba, Japan

[73] Assignee: Kawasaki Steel Corporation, Kobe, Japan

[21] Appl. No.: 381,593

[22] Filed: Jul. 18, 1989

[30] Foreign Application Priority Data

Jul. 18, 1988 [JP] Japan ..... 63-177028

[51] Int. Cl.[5] ..... C21C 7/00

[52] U.S. Cl. ..... 75/508

[58] Field of Search ..... 75/49, 58, 59.1, 508

[56] References Cited

U.S. PATENT DOCUMENTS

| | | | |
|---|---|---|---|
| 3,575,695 | 4/1971 | Miyashita | 75/57 |
| 3,925,061 | 12/1975 | Carlsson | 75/57 |
| 3,971,655 | 7/1976 | Takashima | 75/59.1 |
| 4,615,511 | 10/1986 | Sherwood | 75/49 |

*Primary Examiner*—Peter D. Rosenberg

*Attorney, Agent, or Firm*—Dvorak and Traub

[57] ABSTRACT

A process of production of high cleanness extra low carbon steel includes steps of producing low carbon rimmed steel by means of a refining furnace, supplying a deoxidization agent to a slag in a laddle for adjusting iron concentration in slag at lower than or equal to 5%, subsequently performing vacuum degassing process with blowing oxygen to lower carbon content in the steel lower than or equal to 0.006%.

7 Claims, 6 Drawing Sheets

PROCESS FOR PRODUCING HIGH CLEANNESS EXTRA LOW CARBON STEEL

BACKGROUND OF THE INVENTION

1. Field of the Invention

The present invention relates generally to a production or manufacturing of high cleaness extra low carbon steel.

2. Description of the Background Art

Conventionally, extra low carbon steel having carbon content less than 0.006% has been produced by preparing molten steel having carbon in a range of greater than or equal to 0.01% and less than or equal to 0.06% by means of a refining furnace, which is no subject deoxidation process and supplied in a form of rimmed steel, and by performing vacuum decarbonization process. In this conventional process of production of the extra low carbon steel, iron concentration T.Fe in iron oxide in a slag remained in a laddle has been in a range of 8% to 25%.

In the process of vacuum decarbonization, reaction of carbon and oxygen is caused for forming carbon monoxide vapor. For example, it has been known that, for decarbonizing the molten steel having carbon content of 400 ppm to reduce carbon content at 30 ppm, 493 ppm of oxygen is required. Oxygen is supplied by oxygen contained in the molten steel and oxygen contained in iron oxide in the slag.

For this purpose, it has been required to maintain high iron concentration (T.Fe) in the slag in the laddle. In decarbonization process for non-deoxidized molten steel by way of RH vacuum degassing apparatus, reaction caused between the molten steel and the slag is relatively small to maintain T.Fe in the slag relatively high even after decarbonization process. The slag can react with impurity or impurities, such as aluminium and so forth, to increase oxygen concentration in the molten steel to degrade cleaness of the produced steel. Furthermore, the slag having high T.Fe flows into a tundish for continuous casting to increase blocking of a continuous casting nozzle.

For this, there has been proposed a technology for reducing T.Fe in slag by supplying a deoxidizing agent in the laddle in Japanese Patent First (unexamined) Publication (Tokkai) Showa No. 59-70710. As will be appreciated, when the deoxidizing agent is supplied to the laddle, it will lead lack of oxygen required for vacuum decarbonization process. Therefore, this prior proposed technology is considered not applicable in practical operation for producing the extra low carbon steel.

SUMMARY OF THE INVENTION

Therefore, it is a principle object of the present invention to provide an effective process for producing high cleaness extra low carbon steel resolving the drawback or defects in the conventional art.

In order to accomplish aforementioned and other objects, a process of production of high cleaness extra low carbon steel, according to the present invention, includes steps of producing low carbon rimmed steel by means of a refining furnace, supplying a deoxidization agent to a slag in a laddle for adjusting T.Fe concentration in slag at lower than or equal to 5%, subsequently performing vacuum degassing process with blowing oxygen to lower carbon content in the steel lower than or equal to 0.006%.

Preferably, the T.Fe concentration in the slag is adjusted less than or equal to 2%.

According to one aspect of the invention, a process for producing high cleaness extra low carbon steel comprises the steps of:

preparing low carbon, non-deoxidized molten steel in a refining furnace adding deoxidizing agent to the molten steel tapped from the furnace to a laddle for adjusting T.Fe in slag at less than or equal to 5% performing vacuum degassing process by means of a vacuum degassing apparatus with blowing oxygen to the molten steel bath for decarbonizing to lower carbon contain less than or equal to 0.006%.

Preferably, the T.Fe in the slag is adjusted to be less than or equal to 2%. The process may further comprises a step of stirring the slag after adding the deoxidizing agent. The stirring of the slag may be performed by bubbling. In the alternative, the stirring of the slag may be mechanically performed by means of a stirring member inserted into the molten steel bath.

In the preferred process, blowing of oxygen may be performed by means of a lance disposed in a degassing chamber.

BRIEF DESCRIPTION OF THE DRAWINGS

The present invention will be understood more fully from the detailed description given herebelow and from the accompanying drawings of the preferred embodiment of the invention, which, however, should not be taken to limit the specific embodiment of the invention, but are explanation and understanding only.

In the drawings.

DETAILED DESCRIPTION OF THE INVENTION

Figure 1:
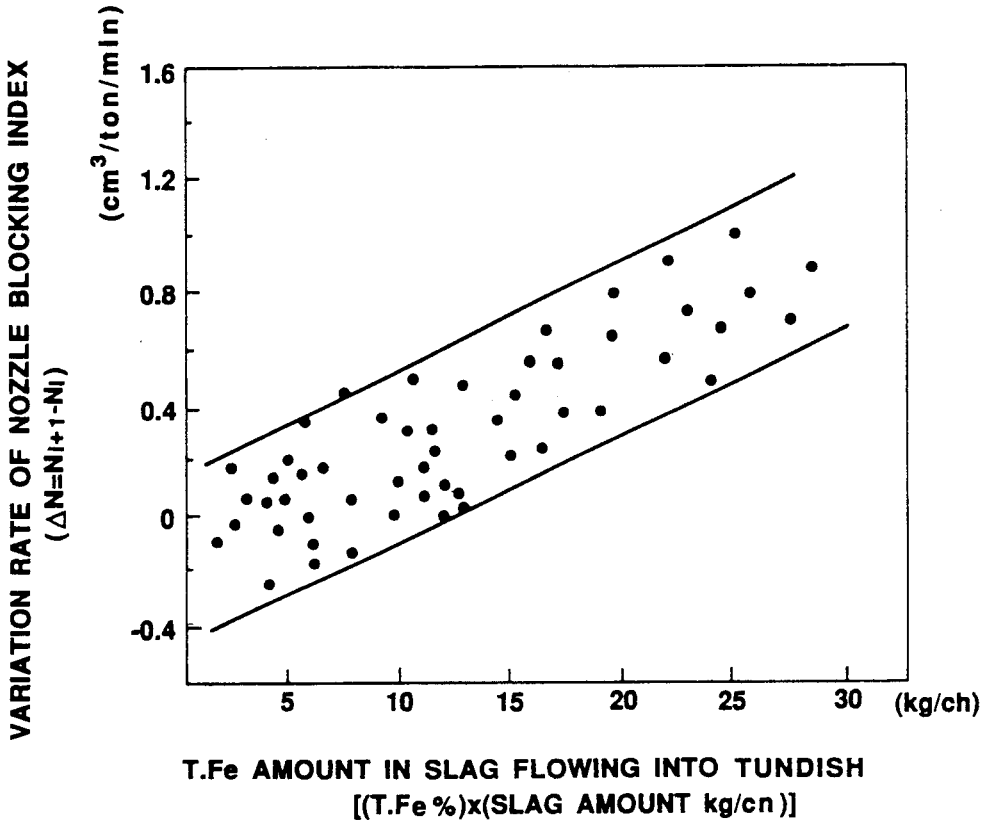
FIG. 1 is a graph showing a relationship between a T.Fe amount in slag in a tundish and variation of a nozzle blocking index

FIG. 1 shows a relationship between T.Fe amount in a slag flowing into a tundish during actual operation, and variation of a blocking index in a nozzle for continuous casting. The variation of the nozzle blocking index herein referred to is derived from variation of opening degree of a sliding nozzle for permitting molten steel flow at a speed of 1 ton/min. In the shown graph, $\Delta N$ represents variation magnitude of nozzle open degree. $N_{i+1}$ is the nozzle open degree of (i+1)th charge. As can be seen from FIG. 1, smaller T.Fe amount in the tundish will reduce nozzle blocking in continuous casting.

In view of this, the preferred T.Fe content (%) (T.Fe amount (kg/ch)/(slag amount (kg/ch)) in the slag is less than or equal to 5%, and further preferably 2%. By limiting T.Fe content in the slag at the preferred ratio, nozzle blocking can be avoided so as not to cause interfere practical operation in the continuous casting.

Reduction of T.Fe content in the slag can be achieved by supplying deoxidizing agent, such as aluminium, aluminium ash which is a slag produced during refining of aluminium, silicon and so forth.

Figure 3:
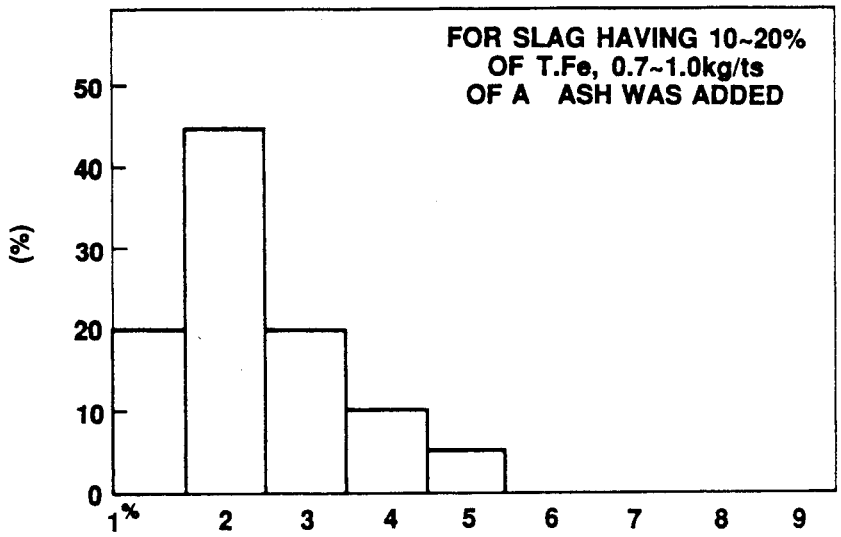
FIG. 3 is a graph showing T.Fe distribution in the slag after reformation
Figure 4:
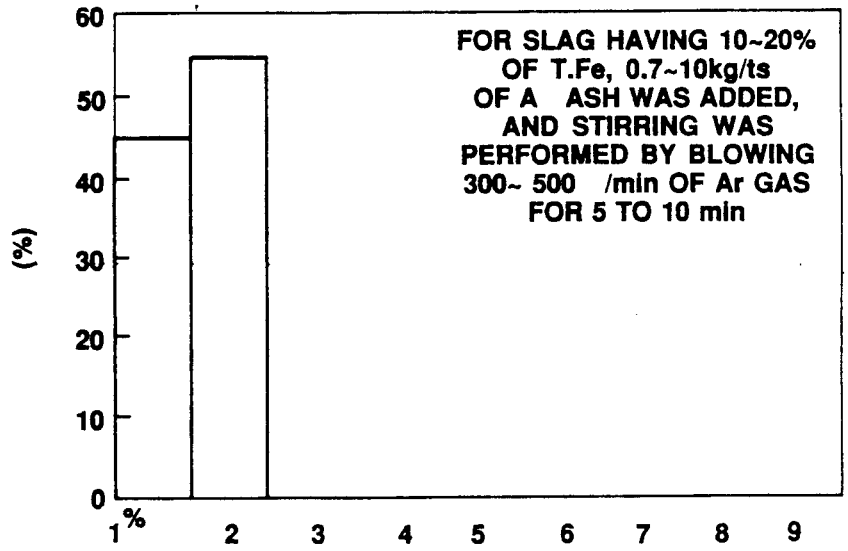
FIG. 4 is a graph showing T.Fe distribution in the slag after stirring reformed slag FIGS. 5(*a*) to 5(*d*) are illustrations showing manner of stirring the slag
Figure 5A:
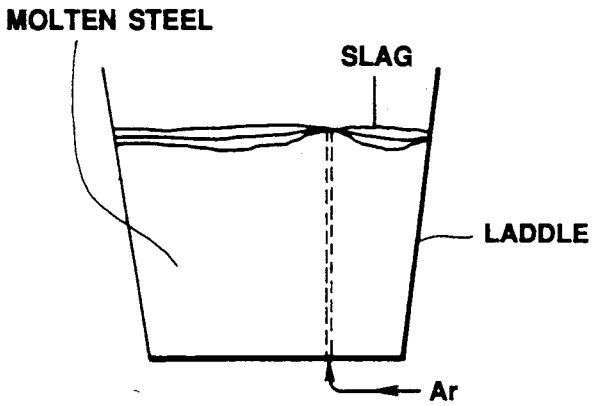
Figure 5B:
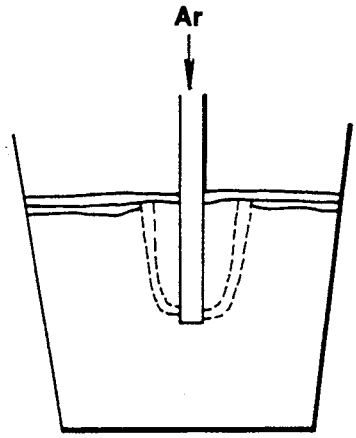
Figure 5C:
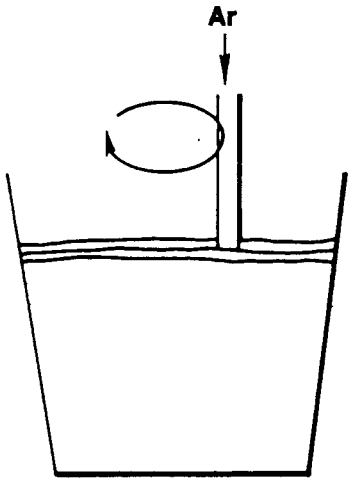
Figure 5D:
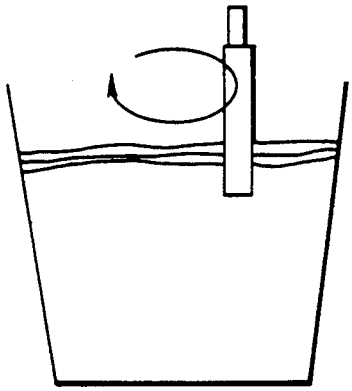

For example, as shown in FIG. 3, by adding 0.7 kg/ts to 1.0 kg/ts for the slag containing 10% to 20% of T.Fe, the T.Fe content in the slag can be reduced to be less than or equal to 5%. Further lowering of the T.Fe content in the slag can be achieved by stirring after adding aluminium ash. Stirring of the slag can be performed in various ways. Examples of practical ways for stirring the slag which can be implemented are shown in FIGS. 5(*a*) to 5(*d*). In FIG. 5(*a*), there is shown a manner of bottom blown bubbling for blowing argon gas from the bottom of the laddle for stirring. FIG. 5(*b*) shows top blown bubbling for blowing argon gas through a lance inserted into the slag for stirring. FIG. 5(*c*) shows mechanical steering by rotating the lance for blowing argon gas. FIG. 5(*d*) shows mechanical steering by means of a stirring bar. In the experiment, in which bubbling by blowing argon gas was performed, reformation of the slag to have T.Fe content being reduced lower than or equal to 2%, could be achieved.

Figure 6:
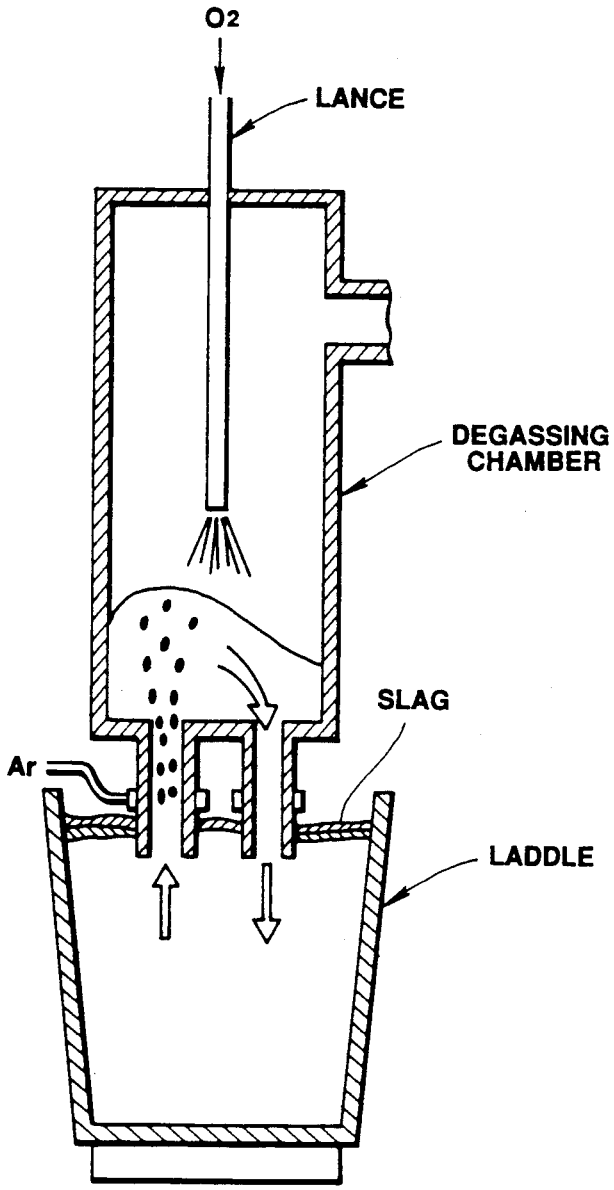
FIG. 6 is an illustration showing apparatus for vacuum degassing to implement the preferred process according to the invention
Figure 7:
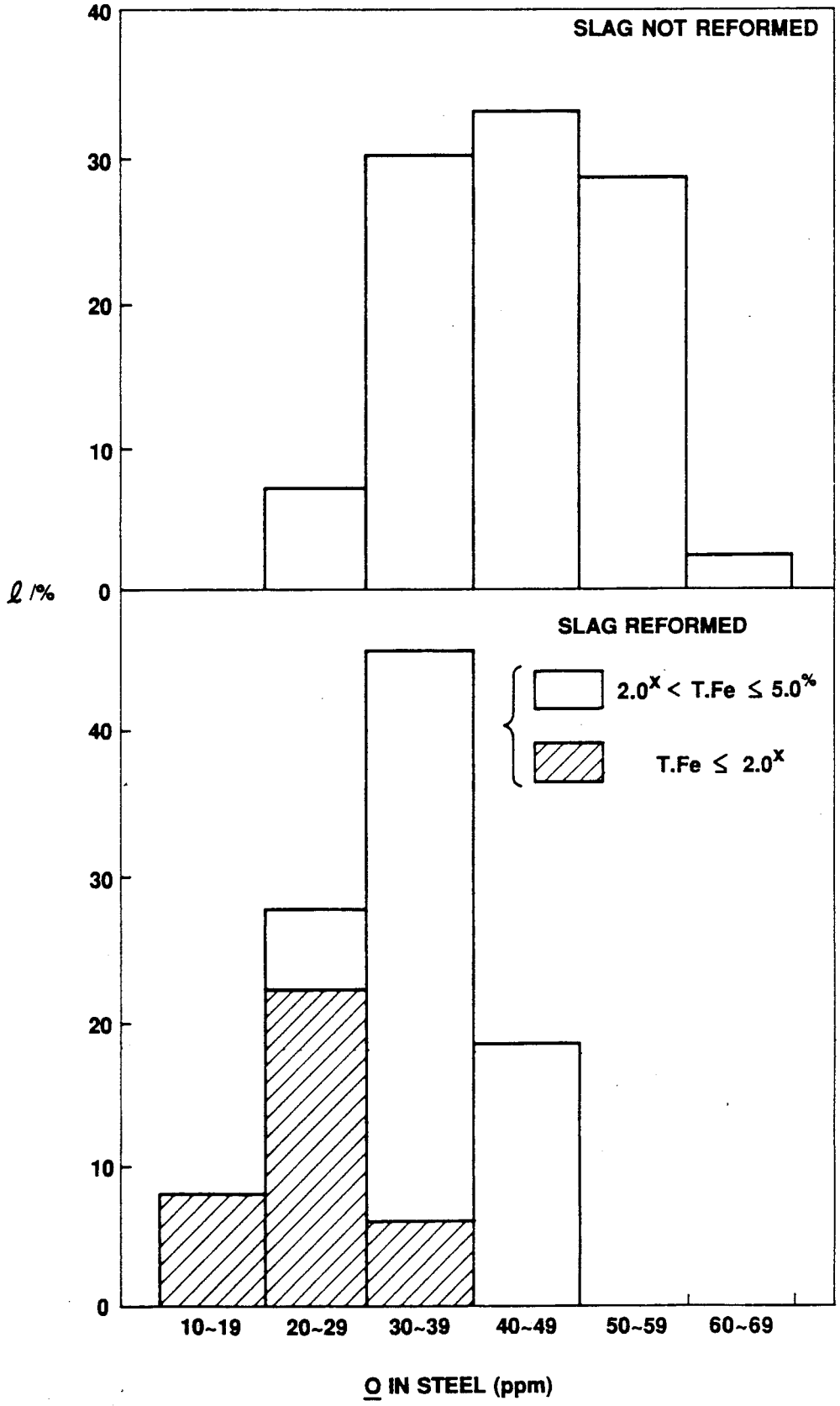
FIG. 7 is a graph showing distribution of oxygen in the steel by reformation of the slag and FIG. 8 is a graph showing a relationship between amount of casting and blocking of nozzle.

As set forth with respect to the conventional art, lacking of oxygen is caused by reduction of T.Fe in the slag during degassing process. Namely, as set forth, degassing is performed by causing oxidation of carbon. Therefore, by reducing T.Fe in the slag for reducing blocking of the nozzle during continuous casting, oxygen amount required for degassing becomes too small. In order to compensate oxygen, the shown embodiment performs top blowing of oxygen during degassing process as shown in FIG. 6. In the alternative, it is possible to blow oxygen directly into the molten steel within a degassing chamber by inserting the lance within a molten steel bath. By compensating oxygen amount by oxygen blowing, decarbonization can be effectively performed to reduce carbon content in the steel to be less than or equal to 0.006%.

Figure 2:
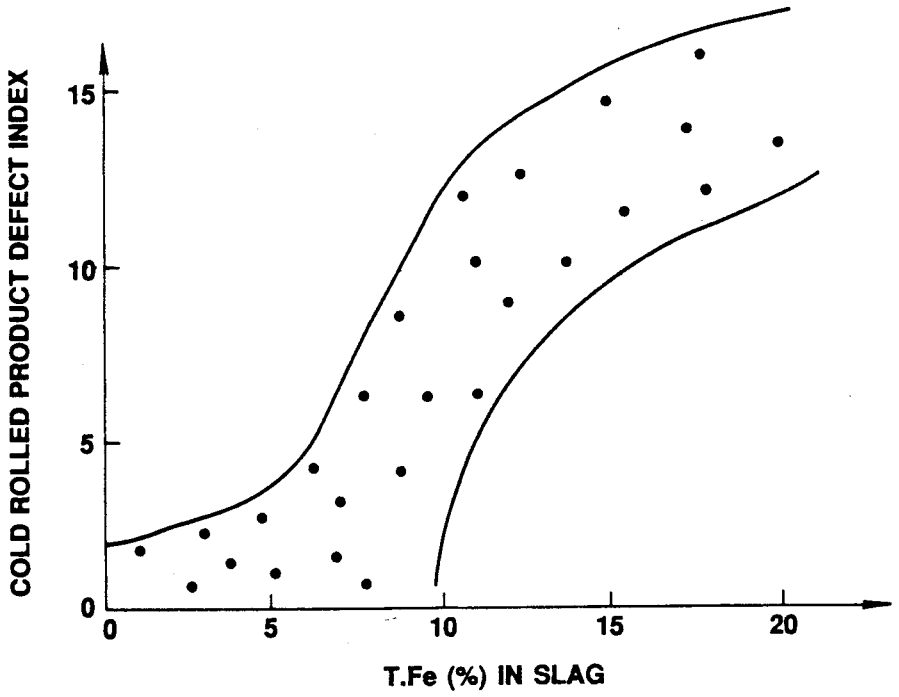
FIG. 2 is a graph showing a relationship between a T.Fe content in the slag and a defect index in cold rolling process

FIG. 2 shows surface defect index of cold rolled steel products, which surface detect index is derived by converting the number and length of defects formed on a coil of the steel strip in a length of 10 m, relation to T.Fe content in the slag. As can be seen herefrom, then T.Fe content is less than or equal to 5%, preferably less than or equal to 2%, substantial reduction of surface defects to be formed during cold rolling process can be obtained.

EXAMPLES

For molten metal in to the laddle tapped from a converter, the aluminium ash having the following contents is added:

metallic Al 52.0 wt %

$Al_2O_3$ 31.5 wt %

$SiO_2$ 5.5 wt % The conditions and results of experimental RH degassing process are shown in the appended table. As can be seen experiments were performed for four examples, i.e. Examples 1 through 4.

As shown, by adding aluminium ash immediately after tapping the molten steel from the converter, the T.Fe content in the slag is maintained at 1.8% to 3.5%. By reduction of T.Fe content in the slag, the oxygen content in the molten steel and the slag becomes in a range of 326 ppm to 442 ppm. On the other hand, actually required oxygen amount for the Examples 1 through 3 are in a range of 494 ppm to 662 ppm. From this, it can be appreciated that compensation of oxygen becomes necessary. Therefore, in the Examples 1 through 3, oxygen was supplied by blowing oxygen through the top blowing lance as illustrated in FIG. 6. On the other hand, for the Example 4, blowing of oxygen was not performed. Therefore, for the Example 4, the carbon content could not be satisfactorily reduced through the RH degassing process.

The rimmed steel thus produced through the degassing process set forth above were further processed by adding aluminium in amount of 1.2 kg/ts to 1.5 kg/ts in a range of period of 5 minutes to 10 minutes for producing extra low carbon killed steel. The resultant killed steel had substantially smaller content of O in comparison with that produced through the conventional process which does not include the step of reforming the slag.

Figure 8:
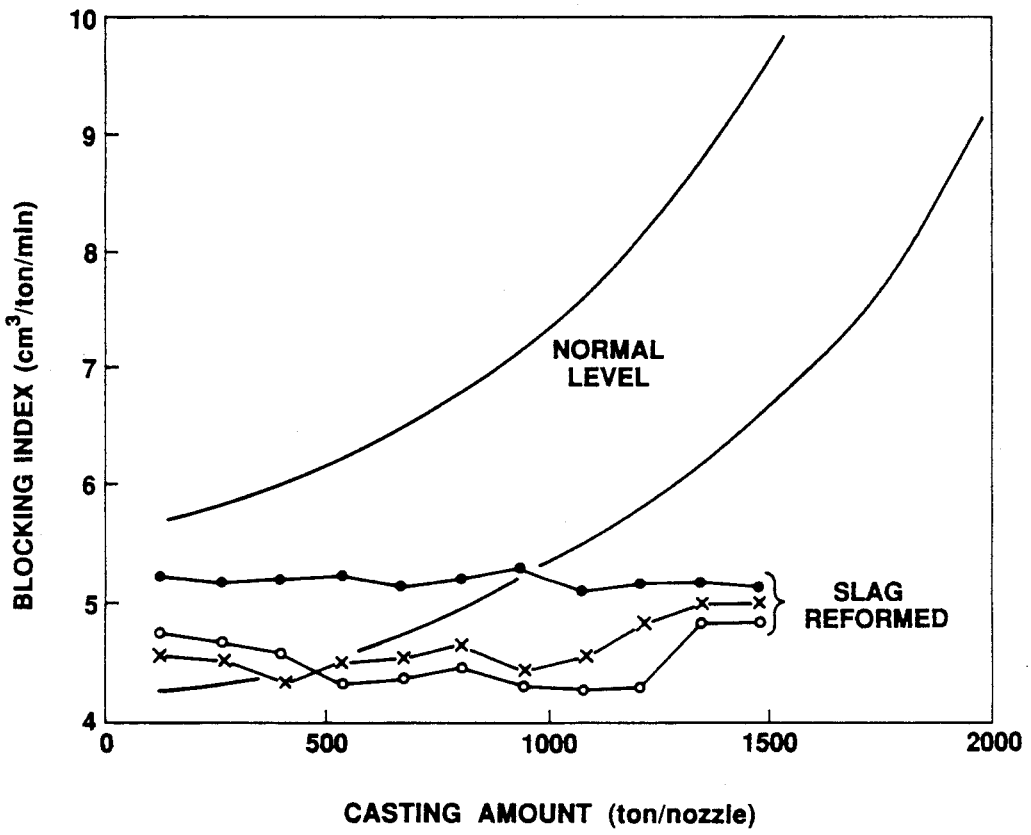

In addition, as shown in FIG. 8, blocking of nozzle could be substantially reduced by utilizing the high cleaness extra low carbon steel produced through the preferred process of the present invention, in the continuous casting. Furthermore, workability of the extra low carbon steel was checked by performing hot rolling and cold rolling to form a cold rolled strip of 0.2 mm to 0.3 mm thick. After cold rolling, the defect index was 1/10 of that produced from the steel made through the conventional process.

Therefore, according to the present invention, high cleaness of extra low carbon steel can be achieved through a simple process.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

TABLE

| | Tapped Steel | | | | Before Decarbonization | | | $O_2$ Blowing Amount and | After Decarbonization | | | Rimmed Process | O Amount for |
|---|---|---|---|---|---|---|---|---|---|---|---|---|---|
| | C % | O ppm | T.Fe % | Al Ash kg/ts | C % | O ppm | T.Fe % | Period $Nm^3$: Min | C % | O ppm | T.Fe % | Period min | Decarbonization ppm |
| Exam. 1 | 0.048 | 528 | 12.8 | 0.8 | 0.052 | 326 | 1.8 | 141:5.5 | 0.0023 | 301 | 1.6 | 14.5 | 662 |
| Exam. 2 | 0.035 | 575 | 15.3 | 0.8 | 0.039 | 442 | 3.5 | 130:5.0 | 0.0019 | 416 | 3.1 | 15.0 | 494 |
| Exam. 3 | 0.050 | 529 | 13.3 | 0.8 | 0.050 | 378 | 2.4 | 122:5.0 | 0.0018 | 306 | 1.9 | 15.0 | 642 |
| Exam. 4 | 0.045 | 550 | 14.0 | 0.8 | 0.046 | 396 | 2.9 | — | 0.027 | 168 | 2.0 | 15.0 | 253 |

What is claimed is:

1. A process for producing high cleaness extra low carbon steel, comprising the steps of:

preparing low carbon, non-deoxidized molten steel in a refining furnace;

adding deoxidizing agent to the molten steel tapped from said furnace to a laddle for adjusting iron concentration of iron oxide in slag at less than or equal to 5%;

performing vacuum degassing process by means of a vacuum degassing apparatus with blowing oxygen to the molten steel bath for decarbonizing to lower carbon content less than or equal to 0.006%.

2. A process as set forth in claim 1, wherein said iron concentration in the slag is adjusted to be less than or equal to 2%.

3. A process as set forth in claim 1, which further comprises a step of stirring the slag after adding said deoxidizing agent.

4. A process as set forth in claim 1, which further comprises a step of stirring the slag after adding said deoxidizing agent for adjusting iron concentration in the slag less than or equal to 2%.

5. A process as set forth in claim 5, wherein stirring of the slag is performed by bubbling.

6. A process as set forth in claim 5, wherein stirring of the slag is mechanically performed by means of a stirring member inserted into the molten steel bath.

7. A process as set forth in claim 1, wherein blowing of oxygen is performed by means of a lance disposed in a degassing chamber.

* * * * *